United States Patent [19]

Buckwalter et al.

[11] 4,073,975

[45] Feb. 14, 1978

[54] PROCESS FOR FLATTING GLOSSY SURFACES OF URETHANE POLYMERS

[75] Inventors: Mervin R. Buckwalter, Lancaster; Edgar W. Knaub, Willow Street, both of Pa.

[73] Assignee: Armstrong Cork Company, Lancaster, Pa.

[21] Appl. No.: 716,985

[22] Filed: Sept. 17, 1976

[51] Int. Cl.[2] ..... D06C 29/00; B05D 5/00

[52] U.S. Cl. ..... 427/170; 427/246; 427/335; 427/379; 427/385 B; 427/388 A

[58] Field of Search ..... 427/170, 246, 379, 385 B, 427/388 A, 335

[56] References Cited

U.S. PATENT DOCUMENTS

| | | | |
|---|---|---|---|
| 2,084,410 | 6/1937 | Platt | 427/170 |
| 3,000,757 | 9/1961 | Johnston et al. | 427/246 |

*Primary Examiner*—Michael R. Lusignan

[57] ABSTRACT

A process for flatting a glossy polyurethane surface is disclosed. The process involves the steps of forming a wear layer on a carrier member, such comprising a polyurethane-forming composition. The coated carrier member is then treated with vaporous water at a temperature below the dew point of the vaporous water so that a film of liquid water is deposited on the surface of the coating. The coating with the liquid water deposited thereon is then cured to a tack free state and then subjected to elevated temperatures where the curing of the polyurethane coating is completed.

7 Claims, 3 Drawing Figures

PROCESS FOR FLATTING GLOSSY SURFACES OF URETHANE POLYMERS

BACKGROUND OF THE INVENTION

1. Field of the Invention

This invention relates to the flatting of glossy surfaces. More particularly, it relates to a method for flatting polyurethane films and coatings.

2. Description of the Prior Art

Floor coverings having polyurethane films as wear layers have been relatively recent developments in the art. Films of these materials are characterized by a combination of toughness, scratch resistance, traffic durability, and high gloss that exceeds that of the conventional films of the prior art, such as the vinyls and the alkyds. While advantageous in many applications, the high gloss associated with polyurethane coatings and films is sometimes objectionable. For example, when such coatings or films are employed over dark colored substrates, minute scratches in the glossy surface appear, such contrasting as starkly white against the dark background. In attempts to subdue the glossiness of these surfaces, fillers such as calcium carbonate and diatomaceous earth have been added to the formulations. Generally, such fillers result in the sacrifice of the physical properties of the wear layer, such as traffic abrasion and tensile strength. The fillers are also responsible for inhibiting the polyurethane-forming reaction, lengthening processing times considerably. As a result, the competitive advantages of the polyurethanes over the prior art wear layer floor coverings are substantially diminished or totally destroyed.

SUMMARY OF THE INVENTION

An object of this invention is to provide a method for delustering glossy surfaces.

Another object of this invention is to provide a method for delustering or flatting the surfaces of polyurethane films and coatings.

Yet another object of this invention is to provide a method for flatting polyurethane films and coatings wherein said flatted film or coating is suitable as a wear layer on flooring materials and the like.

Other objects will hereinafter appear.

DESCRIPTION OF THE PREFERRED EMBODIMENTS

Figure 1:
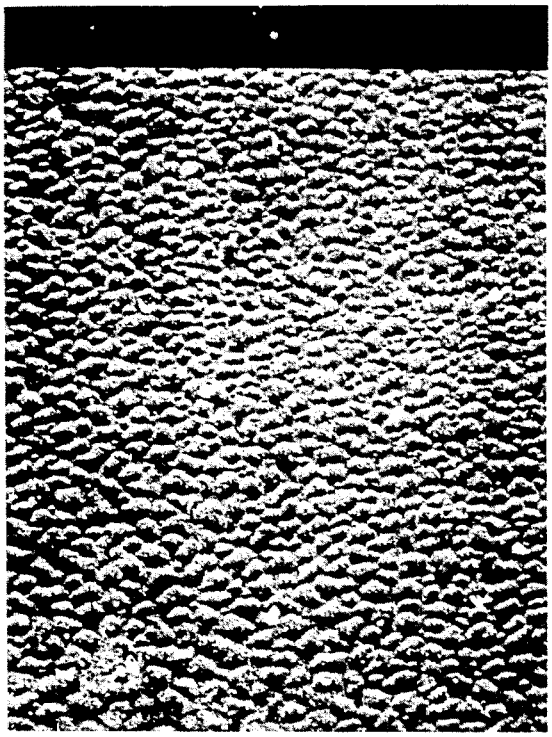
FIG. 1 is a photomicrographic top view (45° angle) of a flatted and cured polyurethane surface in accordance with the present invention at a 100× magnification.

The process of this invention includes forming a polymeric coating or film on a substrate, such coating comprising a polyurethane. The polyurethane coating is formed by chain extending the reaction product of at least one polyol and at least one diisocyanate with at least one compound having two hydrogen atoms, coating a substrate with the polymeric solution, and exposing the coated substrate to a flatting environment characterized by having the substrate and coating or film thereon at a temperature below the dew point of vaporous water so as to deposit thereon a thin film of water. The coating or film having the thin film of water deposited thereon is then cured below 200° F. to a tack free state. Curing is completed at an elevated temperature. Although the coating can be applied at 100% solids, it is desirable to have the solids dissolved in a suitable solvent. When a solvent is used, solids content of up to 75%, and preferably 40% to 60% are used.

A simplified flow diagram of the process of this invention is as follows:

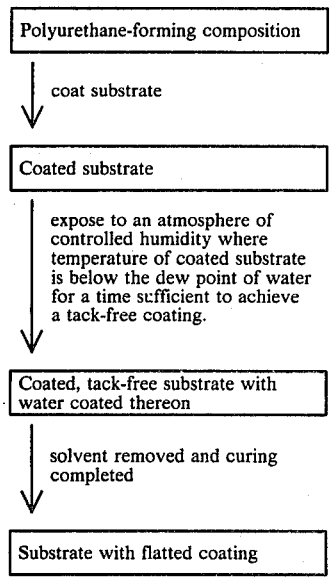

In practicing the method of this invention, the first step is to prepare a solution of polyurethane-forming materials in a suitable solvent. Particularly preferred for these polyurethane-forming materials are those compounds which, on reaction, result in a polyurethane elastomer, such as made by reacting an organic diisocyanate with an active hydrogen-containing polymeric material.

Aromatic, aliphatic, and cycloaliphatic diisocyanates or mixtures thereof can be used in forming the polyurethane elastomeric solution. Such diisocyanates are, for example, toluene-2,4-diisocyanate, toluene-2,6-diisocyanate, meta-phenylene diisocyanate, biphenylene-4,4'-diisocyanate, methylene bis(4-phenylisocyanate), 4-chloro-1,3-phenylene diisocyanate, naphthylene-1,5-diisocyanate, tetramethylene-1,4-diisocyanate, hexamethylene-1,6-diisocyanate, decamethylene-1,10-diisocyanate, cyclohexylene-1,4-diisocyanate, methylene bis(4-cyclohexylisocyanate), tetrahydronaphthalene diisocyanate, and isophorone diisocyanate. Alkylene diisocyanates, that is isocyanates in which the isocyanate groups are attached to an aliphatic ring, are preferred. In general, they give coating materials particularly useful for floorings, lacking any inclination to yellow with exposure to air and light.

By active hydrogen-containing polymeric materials is meant to include those polymeric glycols such as polyalkylene ether glycols and hydroxy-terminated polyesters. A polyalkylene ether glycol is the preferred active hydrogen-containing polymeric material for the polyurethane forming composition. The most useful polyglycols have a molecular weight of 300 to 5000, preferably 400 to 2000 and include, for example, polyethylene ether glycol, polypropylene ether glycol, polytetramethylene ether glycol, polyhexamethylene ether glycol, polyoctamethylene ether glycol, polynonamethylene ether glycol, polydecamethylene ether glycol, polydodecamethylene ether glycol, and mixtures thereof. Polyglycols containing several different radicals in the molecular chain, such as, for example, the compound $$HO(CH_2OC_2H_4O)_nH$$

wherein $n$ is an integer greater than 1, can also be used.

Polyesters which can be used instead of, or in conjunction with, the polyalkylene ether glycols disclosed above are, for example, those formed by reacting acids, esters, or acid halides with glycols. Suitable glycols are polymethylene glycols such as ethylene, propylene, tetramethylene and decamethylene glycols; substituted polymethylene glycols such as 2,2-dimethyl-1,3-propane diol; cyclic glycols such as cyclohexane diol; and aromatic glycols such as xylylene glycol. Aliphatic glycols are generally preferred when maximum product flexibility is desired. These glycols are reacted with aliphatic, cycloaliphatic, or aromatic dicarboxylic acids or lower alkyl esters or ester-forming derivatives thereof to produce relatively low molecular weight polymers, preferably having a melting point of less than about 70° C., e.g., molecular weights of and molecular weights like those indicated for the polyalkylene ether glycols. Acids for preparing such polyesters are, for example, succinic, adipic, suberic, sebacic, terephthalic and hexahydroterephthalic acids, and the alkyl and hydrogen-substituted derivatives of these acids.

The polyurethanes formed from the above-mentioned glycols and diisocyanates, in accordance with this invention, are chain extended, preferably with water. It is advantageous to have the isocyanate in excess of the glycols by a ratio of NCO:OH of at least 1.2:1 and not more than 2.2:1. Preferably, the NCO:OH ratio is 1.7:1. The polyurethane elastomer is most easily prepared by first mixing a molar excess of the diisocyanate with the active hydrogen-containing polymeric material and heating the mixture at about 50°–120° C. until a prepolymer is formed. In an alternate method, the diisocyanate can be reacted with a molar excess of the active hydrogen-containing polymeric material and the reaction product capped by reacting it with more diisocyanate to form a prepolymer. In either case, the resulting prepolymer is available for further curing due to the reactive isocyanate end groups. These prepolymers are then dissolved in a suitable solvent or used without a solvent to coat the substrates in accordance with the present invention. The polyurethane coating can also be formed in situ on the substrate to be coated by admixing, in a suitable solvent, an excess of organic diisocyanate and the active hydrogen-containing polymeric material.

The coating may be applied on the surface of the substrate by various coating procedures employed in the art, such as roll coating, doctor knife coating, air knife coating, air spraying, airless spraying, gravure printing, and curtain flow coating. The amount of polyurethane prepolymer or polyurethane-forming component to be coated is determined according to the end use of the resulting product. In the present invention, the coating has a thickness of 4 to 8 mils after drying. Unless the thickness of the dried film is at least 2 mils, the roughness and durability of the flooring wear surface cannot be attained. If, on the other hand, the thickness exceeds 8 mils, elevated temperature curing reactions are inhibited and economically disadvantageous amounts of wear layer are applied. When the thickness of the coating is 4 mils or less, it is usually simple, according to the process of this invention, to apply the coating and to control other conditions successfully.

To form the flatted polyurethane coating, the polyurethane-forming components or the polyurethane prepolymer is preferably first dissolved in a volatile solvent. Since the major function of the volatile solvent is to reduce the viscosity of the coating so that it can be applied by the methods as disclosed above, the actual composition of the solvent is not critical. However, such should be of sufficient volatility so as to be easily removed during the high temperature curing operation. In addition, it is desirable to have a solvent that is nonreactive with the isocyanate component in the coating. Suitable solvents include the aromatic solvents, such as benzene, toluene and xylene, as well as the aliphatic solvents, such as tetrahydrofuran, methylethylketone and the like. In some cases, where the viscosity of the components is not critical, the solvent may be omitted entirely.

The solution of the polyurethane-forming materials is next coated onto a substrate which, for most flooring applications, is preferably a vinyl substrate. However, the actual substrate useful in accordance with the present invention is not critical, and such may be a porous fiber substrate such as those from woven twills, drills, ducks and the like. Similarly, the films or coatings in accordance with the present invention may be applied onto an impervious substrate of, for example, glass or stainless steel.

After the solution of the polyurethane-forming components or polyurethane prepolymer have been applied to the substrate, the coated substrate is exposed to an atmosphere containing water vapor in a flatting chamber. While the temperature within the flatting chamber can be any temperature up to 200° F., the atmosphere in such chamber can be characterized by having a relative humidity such that, when the substrate containing the coating or film enters such chamber, a thin film of water deposits on the surface of the coating or film. In order to accomplish such depositing of liquid water from the flatting chamber environment, it is necessary to have the substrate and coating or film thereon at a temperature below the dew point of vaporous water within the flatting chamber. By dew point as used herein is meant the temperature below which liquidification of water vapor from the chamber onto the substrate occurs, e.g., the dew point is the temperature at which a sample of air has a humidity of 100%. Thus, in accordance with this invention, when the flatting chamber has a relative humidity of 100% and the polyurethane-forming coating overlying the substrate, a temperature of 75° F., a thin film of vaporous water will condense from the atmosphere of the chamber on the coating. Similarly, when the flatting chamber has an 80% relative humidity, the substrate will necessarily be at a temperature of about 52° F. to condense water vapor as liquid onto the coating (the difference between the dry bulb and wet bulb temperatures measured on an hygrometer of 2° C.). The relationship of humidity and dew point to wet and dry bulb readings is well known in the prior art and can be found detailed in any standard technical reference book such as, for example, Lange's Handbook of Chemistry.

The polyurethane-forming film or coating is allowed to remain in the flatting chamber with the liquid water deposited thereon for long enough so as to achieve a degree of cure that is defined as tack free. By tack free is meant dry to the touch, e.g. having no tackiness.

Figure 2:
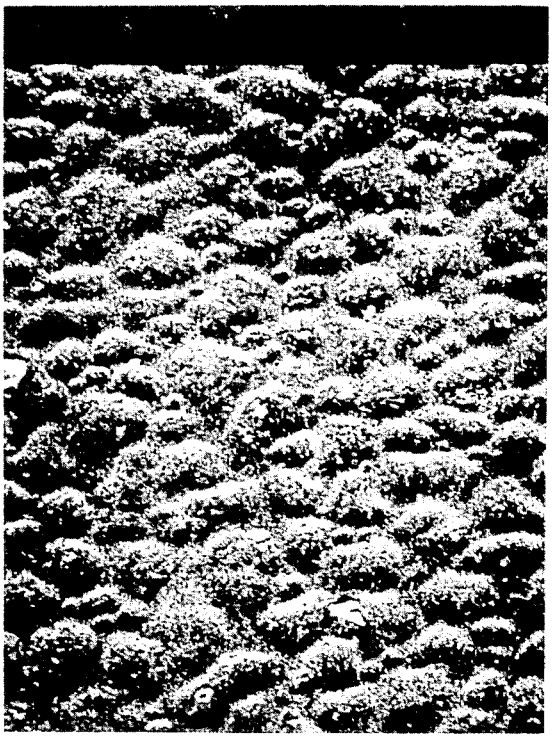
FIG. 2 is a photomicrographic top view (45° angle) of the surface as in FIG. 1 at 300× magnification.
Figure 3:
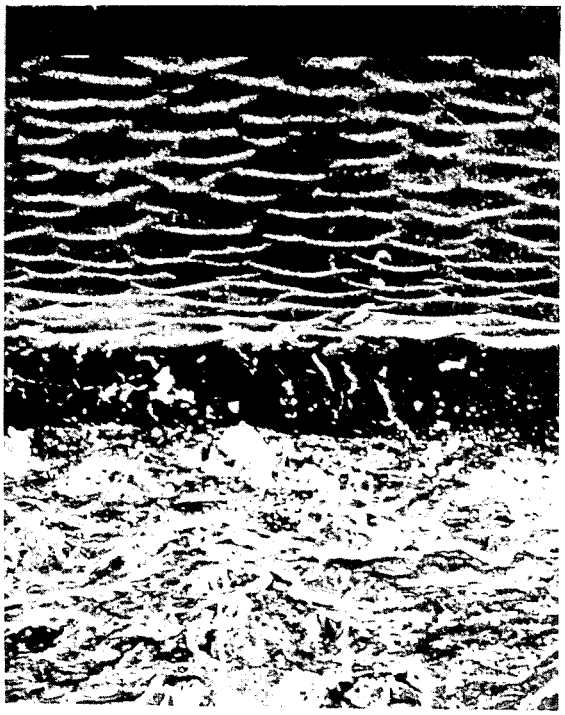
FIG. 3 is a photomicrographic oblique view of the surface as in FIG. 1, the surface at a 20° angle to the camera at 300× magnification.

Once the tack-free state occurs, there is introduced into the surface of the coating or film imperfections that result in a decrease in the gloss of such film or surface. Such imperfections are illustrated in the figures. The figures are photographs of the flatted surfaces in accordance with the present invention taken with a scanning electron microscope (JOEL Model JSM U3) with an accelerating voltage of 25KV. FIG. 1 is an overall top view of the flatted and cured polyurethane surface resulting from the process of the present invention taken with the scanning electron miscroscope at 100× magnification. The form of the flatted surface is more clearly seen in FIG. 2, the same surface as FIG. 1, but at 300× magnification. What appeared to be bubbles in the surface in FIG. 1 is seen to be minute, approximately circular, depressions—the depressions breaking up any incident light rays imparting the surface so as to give the overall flatted effect. The gloss reading of such surface was estimated to be about 30 (see examples for further discussion). Further examination of the flatted surface is shown in FIG. 3 where the sample of the first two figures is viewed at an angle of 20° with the scanning electron microscope. The white, flaky material is a cross-sectional view of the substrate carrier sheet. The cured polyurethane coating overlaying the carrier sheet is seen in cross section as a black band with the top flatted surface clearly visible as including many minute depressions in the surface of the top layer. Depending on the time in and temperature of the flatting chamber, the depth and frequency of these depressions can be controlled and thus the gloss of the final cured polyurethane coating. FIG. 3, at an estimated gloss of 30, has an average depression of depth of 3 microns and represents the maximum depression achieved in the flatting process. This sample was similar to Example 1, as exemplified below. While temperatures and humidity in the flatting chamber can be varied considerably as long as the coating to be flatted is below the dew point at such humidity and temperature, it is important not to exceed temperatures of significantly greater than 200° F. At flatting chamber temperatures greater than 200° F., very little flatting is observed in these polymeric systems. While temperatures below about 60° F. can be used, they are not preferred since undue times within the chamber are necessary to achieve the tack-free state. When the substrate (carrier member) and coating thereon is at 60° to 150° F., flatting chamber temperatures of 70° to 200° F. with relative humidity conditions of 70 to 95% are preferred. These conditions achieve acceptable flatting with times of as little as 1 minute to 24 hours.

The coated substrate, as it exits the flatting chamber, has only been cured to a tack-free state and, without subsequent treatment, does not provide a suitable wear layer for any flooring material. The final step in the process, then, is to remove solvent, if such is used, from the partially cured, tack free, flatted surface, and to completely cure the coating. While such final curing may be accomplished at ambient temperatures, it is preferable to pass the coated substrate into a curing chamber so as to rapidly cure and form the final product. In the curing chamber both chain extension and cross-linking of the polyurethane-forming components is accomplished. For example, if polyfunctional components are present, cross-linking and chain extension and rubber-like materials result. For difunctional components, chain extension is most prevalent. These reactions for diisocyanates and polyols are well known in the prior art. Temperatures up to 350° F. have been found advantageous for such rapid curing chamber.

It should be noted that only by the process in accordance with the present invention is a satisfactorily flatted surface obtained. For example, spraying liquid water onto the uncured coating gives cured coatings of rough surface character having holes and pores. If the substrate coated with the polyurethane-forming solution is dipped into water and cured, the resulting polymeric coatings are often blotchy and contain bubbles.

The process of this invention makes it possible to deposit strong, flexible and flatted coatings which have no visible pores and which do not noticeably accumulate traffic dirt, and the like. These films cannot only be used for flooring materials such as vinyl and wood coatings, but also find application as leather substitutes in upholstery, baggage, handbags, gloves, boots, and clothing.

The following examples are intended to illustrate the invention and not to limit it in any way. Parts are by weight unless otherwise specified.

EXAMPLES 1–7

The following Tables I and II illustrate the polyurethane-forming formulas and the flatting achieved in practicing the process in accordance with the present invention.

Table I

| Component, Approximate Equivalent Weight[a] | 1 | 2 | 3 | 4 | 5 | 6 | 7 |
|---|---|---|---|---|---|---|---|
| 4,4'-dicyclohexylmethane diisocyanate, 131 | 1.95 | 1.72 | 1.95 | — | — | — | — |
| Isophorone diisocyanate, 111 | — | — | — | 2.0 | — | — | — |
| Desmodier N, 196 | — | — | — | — | 0.38 | 0.28 | — |
| 2,4-toluene diisocyanate, 87 | — | — | — | — | — | — | 1.5 |
| polypropyleneoxide triol, 239 | 0.55 | 0.50 | 0.50 | — | — | — | 0.741 |
| polypropyleneoxide triol, 870 | — | — | — | — | — | 0.23 | — |
| polypropyleneoxide diol, 217 | 0.22 | 0.25 | — | — | — | — | — |
| polypropyleneoxide diol, 387 | 0.23 | — | — | — | — | — | 0.131 |
| polyethyleneoxide diol, 200 | — | 0.25 | — | — | — | — | — |
| polycaprolactone diol, 300 | — | — | — | 1.0 | — | — | — |
| polycaprolactone diol, 180 | — | — | 0.50 | — | — | — | — |
| % solids (xylene solvent) | 45 | 50 | 42 | 45 | 75 | 60 | 45 |
| viscosity, cps | 286 | 120 | 110 | 80 | — | — | — |

Table I-continued

| Component, Approximate Equivalent Weight[a] | 1 | 2 | 3 | 4 | 5 | 6 | 7 |
|---|---|---|---|---|---|---|---|
| Gloss[c] | 24 | 100+[d] | 9 | 100+[d] | 7 | 9 | 5 |

[a]All examples contain 0.1% Ionol stabilizer and 0.1% dibutyltin dilaurate.
[b]A triisocyanate condensation product of 3 moles of 1,6-hexamethylene diisocyanate with 1 mole of water, from Mobay Chemical Company.
[c]6 mil films on glass at 75° F. for 30 minutes in air before insertion into flatting chamber for 8 hours. Flatting chamber at 100° F. and 80% R. H. measurements with a Gardner Portable 60° Glossmeter, 0–100 scale. Final cure in an electric oven at 350° F.
[d]Essentially a glossy surface. These values exceeded the capacity of the Glossmeter. These samples were still tacky after 8 hours in the flatting chamber.

Table II

| Time at Room Temperature[a] (minutes) | Gloss Example 3 | Gloss Example 7 |
|---|---|---|
| 3 | 29 | 44 |
| 30 | 9 | 5 |
| 60 | 4 | 6 |
| 90 | 9 | 6 |
| 120 | 20 | 15 |
| 150 | 51 | 50 |
| 180 | 100+ | 90 |
| 200 | — | 100+ |

[a]The samples were inserted into the flatting chamber at 100° F. and 80% RH for 8 hours after the above air exposure. The final cure was accomplished in an electric oven at 350° F.

What is claimed is:

1. A process for delustering a glossy polyurethane surface comprising:
   (a) applying to a carrier member a coating of a solution of a curable polyurethane-forming composition in a diluent consisting of a solvent for said polyurethane-forming composition;
   (b) treating the coated carrier member with vaporous water at a temperature of 70° to 200° F., said carrier member at a temperature of 60° to 150° F. and below the dew point of said vaporous water whereby a thin film of liquid water is deposited on the surface of said coatings;
   (c) partially curing said coating having said thin film of water deposited thereon to a tack-free state; and
   (d) completing the cure of said polyurethane-forming composition.

2. The process in accordance with claim 1 wherein said polyurethane-forming composition is the reaction product of at least one cycloaliphatic diisocyanate and at least one polyol selected from the group consisting of polyalkylene ether polyol of molecular weight 300–5000 and polyester polyol of melting point less than 70° C. wherein the NCO:OH is from 1.2:1 to 2.2:1.

3. The process in accordance with claim 1 wherein said carrier member is at said temperature for from 1 minute to 24 hours.

4. A flatted polyurethane surface comprising depressions in said surface of up to about 3 microns and formed by:
   a. applying to a carrier member a coating of a solution of a curable polyurethane-forming composition in a diluent consisting of a solvent for said polyurethane-forming composition;
   b. treating the coated carrier member with vaporous water at a temperature of 70° to 200° F., said carrier member at a temperature of 60° to 150° F. and below the dew point of said vaporous water whereby a thin film of liquid water is deposited on the surface of said coatings;
   c. partially curing said coating having said thin film of water deposited thereon to a tack-free state; and
   d. completing the cure of said polyurethane-forming composition.

5. The process in accordance with claim 1 wherein said coated carrier member is at 75° F. and said vaporous water is at 100° F.

6. The process in accordance with claim 5 wherein said carrier member is at said temperature for 8 hours.

7. The process in accordance with claim 1 wherein said final cure is 350° F.

* * * * *